US005460145A

United States Patent [19]

Perry, Jr.

[11] Patent Number: 5,460,145

[45] Date of Patent: Oct. 24, 1995

[54] MOTORCYCLE SUPERCHARGER DRIVE ASSEMBLY

[76] Inventor: Leroy R. Perry, Jr., 1301 E. Rubio, Altadena, Calif. 91001

[21] Appl. No.: 251,282

[22] Filed: May 31, 1994

[51] Int. Cl.[6] ..... F02B 33/00

[52] U.S. Cl. ..... 123/559.1; 403/359

[58] Field of Search ..... 123/559.1; 403/359, 403/361, 299, 342

[56] References Cited

U.S. PATENT DOCUMENTS

| | | | |
|---|---|---|---|
| 1,265,418 | 5/1918 | Baldwin | 403/359 |
| 2,201,693 | 5/1940 | Heess et al. . | |
| 2,254,927 | 9/1941 | Archambeau . | |
| 2,525,695 | 10/1950 | Lombard | 403/359 |
| 2,681,646 | 6/1954 | Holpfer . | |
| 2,756,735 | 7/1956 | Oehrli . | |
| 2,839,038 | 6/1958 | Middlebrooks, Jr. . | |
| 2,844,133 | 7/1958 | Thompson . | |
| 4,417,559 | 11/1983 | Matsuda et al. . | |
| 4,444,013 | 4/1984 | Inoue et al. . | |
| 4,480,712 | 11/1984 | Inoue et al. . | |
| 4,482,024 | 11/1984 | Matsuda et al. . | |
| 4,495,773 | 1/1985 | Inoue et al. . | |
| 4,723,526 | 2/1988 | Horiuchi et al. . | |
| 4,844,044 | 7/1989 | McGovern . | |
| 4,907,552 | 3/1990 | Martin . | |
| 4,998,524 | 3/1991 | Black et al. . | |
| 5,085,199 | 2/1992 | Sado et al. . | |
| 5,263,463 | 11/1993 | Perry . | |

FOREIGN PATENT DOCUMENTS

| | | | |
|---|---|---|---|
| 1258866 | 3/1961 | France | 403/299 |
| 2543073 | 4/1976 | Germany | 123/559.1 |
| 1-301919 | 12/1989 | Japan | 123/559.1 |
| 196127 | 8/1990 | Japan . | |

*Primary Examiner*—Michael Koczo
*Attorney, Agent, or Firm*—William W. Haefliger

[57] ABSTRACT

A cover plate attachable to a motorcycle to cover transmission structure, and an annular bore surface on the cover plate defining an axis coincident with the motorcycle engine drive shaft axis comprising a sprocket shaft axially spaced from the drive shaft; a compensating nut on the sprocket shaft; an output pulley drive shaft coaxially aligned and coupled to the sprocket shaft and the compensating nut, and an output pulley on the output pulley drive shaft for transmitting drive to a supercharger for the engine.

8 Claims, 7 Drawing Sheets

12b
12
14
14
15
15a
23
24
26
28
30
60a
11c
21
21a
13
60
10b
60a
19
20
52
11d
41
50
47
48
49
18
12a
10
46

MOTORCYCLE SUPERCHARGER DRIVE ASSEMBLY

BACKGROUND OF THE INVENTION

This invention relates generally to supercharging of motorcycle engines, and more particularly to compact, simple, drive apparatus for motorcycle superchargers.

There is need for simple, efficient, supercharging means for motorcycle engines. In particular, there is need for supercharger drive apparatus, whereby a stock motorcycle cover plate can be used in combination with the drive, obviating need for creating a separate and different design cover plate for each year and type motorcycle model.

SUMMARY OF THE INVENTION

It is a major object of the invention to provide improved drive means meeting the above need. As will be seen, an annular bore surface is provided on the cover plate that normally covers transmission structure, and the following elements are also provided:

a) a sprocket shaft axially spaced from the drive shaft, b) a compensating nut on the sprocket shaft, c) an output pulley drive shaft coaxially aligned and coupled to the sprocket shaft and the compensating nut, and an output pulley on the output pulley drive shaft for transmitting drive to a supercharger for the engine, d) and mounting means extending about the output pulley drive shaft, and received adjacent the annular bore surface on the cover plate to center the output pulley drive shaft in spaced relation to the engine drive shaft.

As will be seen the compensating nut and the output pulley drive shaft have telescopically interfitting parts for transmitting rotation from the output pulley drive shaft to the sprocket shaft via the nut. Those parts may advantageously comprise a recess in the nut facing the output pulley drive shaft, and a lug on the output pulley drive shaft to be fittingly received, axially, in the recess.

Another object includes the provision of a sprocket shaft end portion that is externally threaded, and the nut is received on and over the end portion and has threaded engagement with the end portion. The nut may typically include a flange, with a recess in the flange in axial alignment with the sprocket shaft. A lug on the output pulley drive shaft is axially received in the recess.

Another object is to create an adapter means whereby a stock primary cover can be utilized, rather than creating a separate cover mold, casting or cover model for each year and type of motorcycle employing a supercharger, whereby cost savings are realized. The universal adapter (output pulley drive shaft support and mounting housing) can be welded, bolted, or secured into a stock, outer, primary cover once an appropriate hole centered with the sprocket crankshaft has been made.

Yet another benefit is that the invention allows for a star-like or circular, belt guard support bracket to project from its base giving extra mounting and stabilizing support to the belt guard shroud which covers and protects the supercharger pulley and belt, as well as the output pulley. This also provides added strength and support for the supercharger itself, as the belt guard is secured to a strong stable base.

A further benefit is that the invention allows for the removal of the outer, primary cover without dismantling or removing the output pulley from the output pulley shaft or sprocket crankshaft. In this regard, the male spline on the compensating crank nut sprocket extension inserts into the female slot on the compensating crank sprocket nut, which is attached to the sprocket crank shaft. The sprocket crankshaft, which attaches to the flywheel within the engine, provides a mechanism whereby the power or rotation from the engine is transferred through the cover plate to the output pulley via the belt to the supercharger 90° or 180° drive or power exchange, thereby providing means to spin the supercharger creating an increase in air and fuel (whether carbureted or fuel injected) volume directly or indirectly supplied to the engine cylinders, creating an increase in horsepower.

These and other objects and advantages of the invention, as well as the details of an illustrative embodiment, will be more fully understood from the following specification and drawings, in which:

DRAWING DESCRIPTION

FIG. 1 is a perspective view of a motorcycle equipped with the supercharger kit, as referred to;

FIG. 1*a* is a right angle drive associated with the supercharger;

FIG. 1*b* is a schematic front view of the FIG. supercharger drive;

DETAILED DESCRIPTION

Figure 1B:
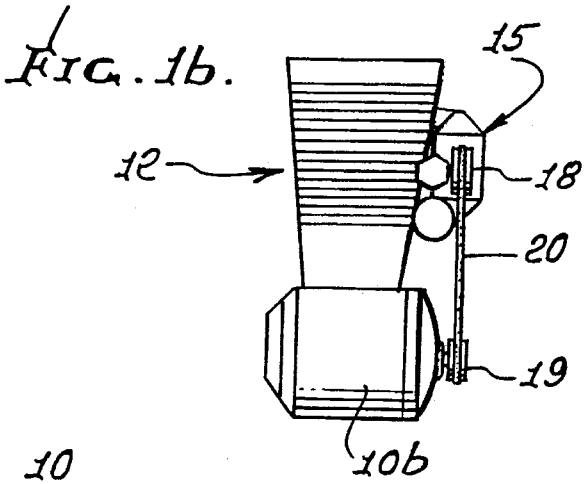
Figure 1A:
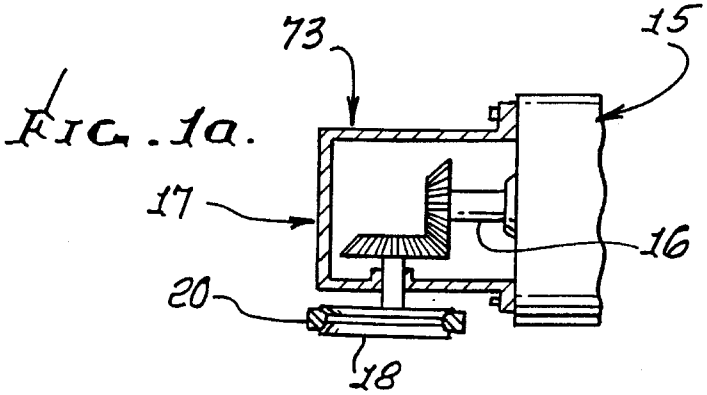
Figure 1:
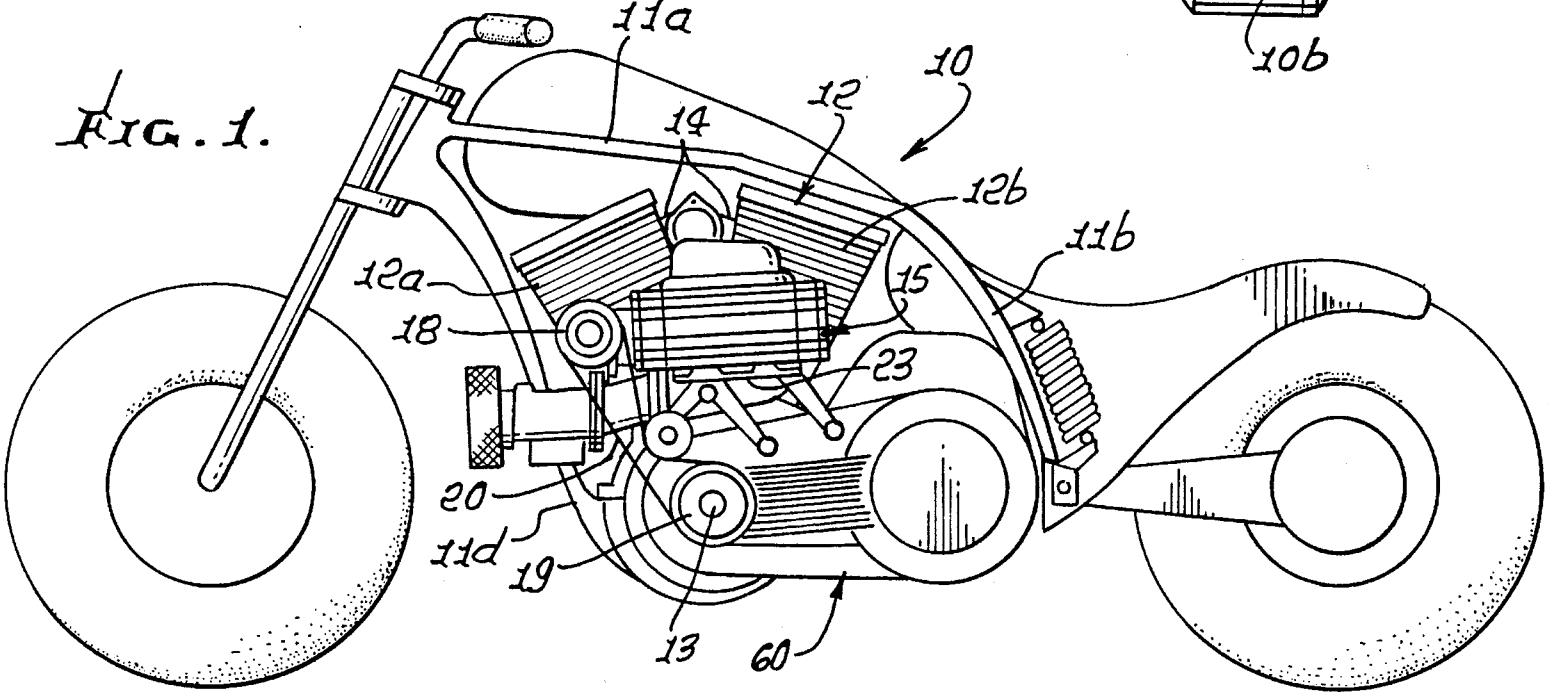
Figure 2:
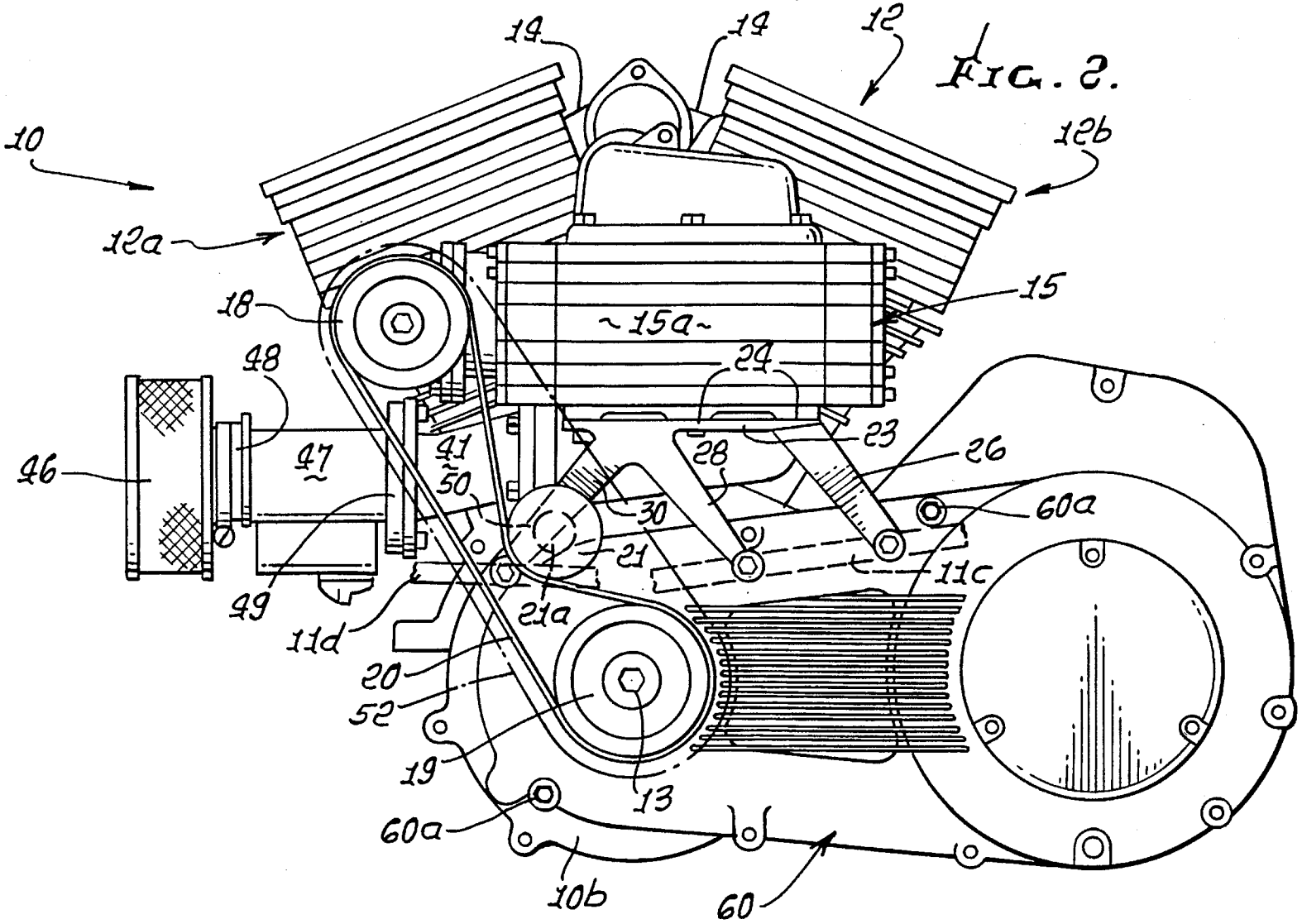
FIG. 2 is an enlarged side elevation showing the supercharger and its kit elements mounted to the motorcycle.
Figure 3:
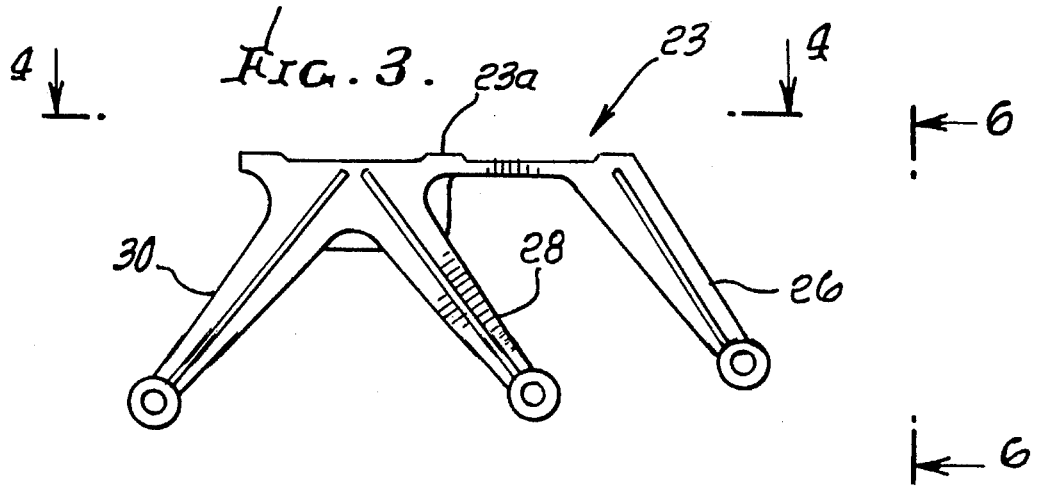
FIG. 3 is a side view of a supercharger housing platform.

In FIGS. 1, 1*a* and 2, the motorcycle 10 has a forwardly extending frame, with frame elements 11*a*–11*d*, as shown, there being other frame elements not shown. The engine 12 has forward and rearward cylinder housings or blocks 12*a* and 12*b* (with suitable air cooling fins), and a power take-off shaft, which may be extended at 13. See FIG. 7. Also, the engine has an air/fuel intake manifold 14 above the level of the power take-off shaft.

A blower 15 (for example, a Roots blower having two counter-rotating lobes) has a longitudinally elongated housing 15*a* containing the blower parts. A blower input shaft 16 in FIG. 1*a* is connected to a drive coupled between that shaft and the power take-off shaft 13. See for example the right angle drive unit 17 in FIG. 1*a*, the driven rotor (such as a pulley) 18 connected to the unit 17, the drive rotor 19 (such as a pulley) on shaft 13, and the endless, flexible element 20 entrained on rotors 18 and 19. Element 20 may comprise a belt, tensioned by an idler pulley 21 rotating on a shaft 21*a*, adjustably mounted, for example, to the motorcycle engine or frame. Thus, the engine drives the supercharger in the manner shown and described. Housing 15*a* is closely adjacent the side of the engine.

Figure 4:
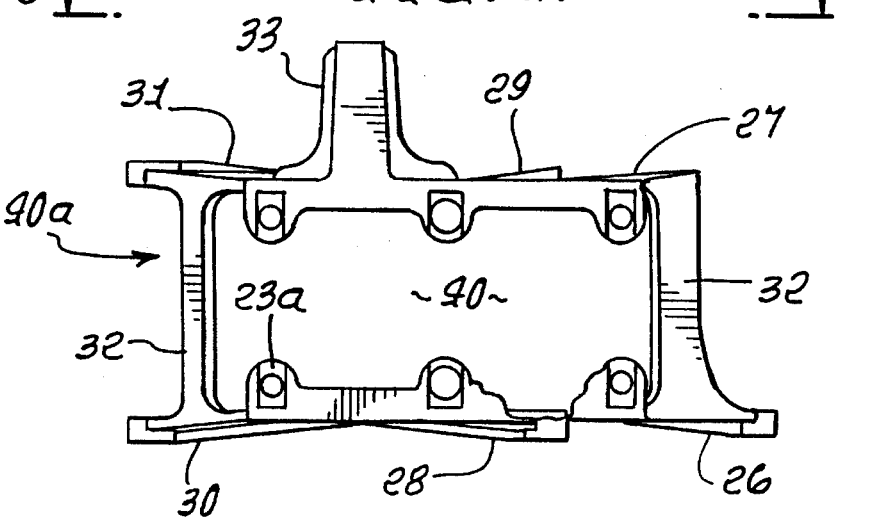
FIG. 4 is a top plan view of the FIG. 3 platform.
Figure 5:
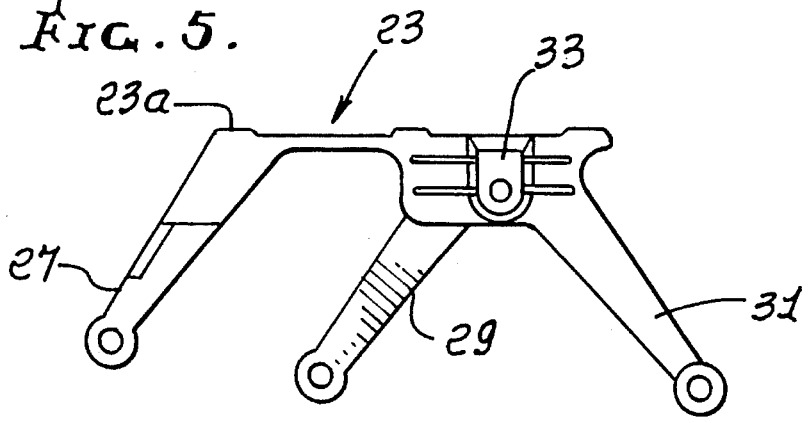
FIG. 5 is a rear side view of the platform taken on lines 5—5 of FIG. 4.
Figure 6:
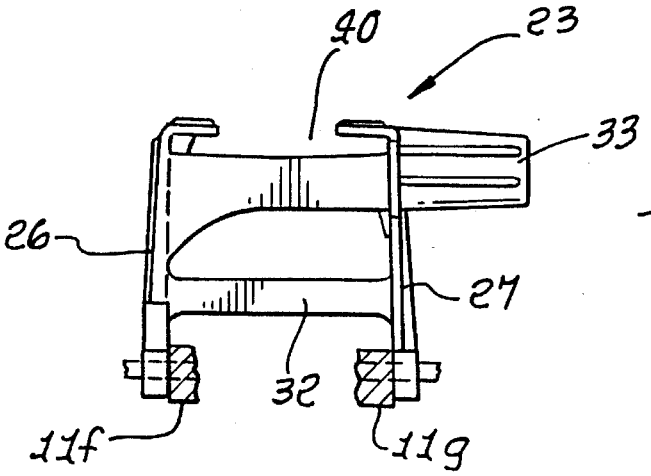
FIG. 6 is a rear end view of the platform taken on lines 6—6 of FIG. 3.
Figure 7:
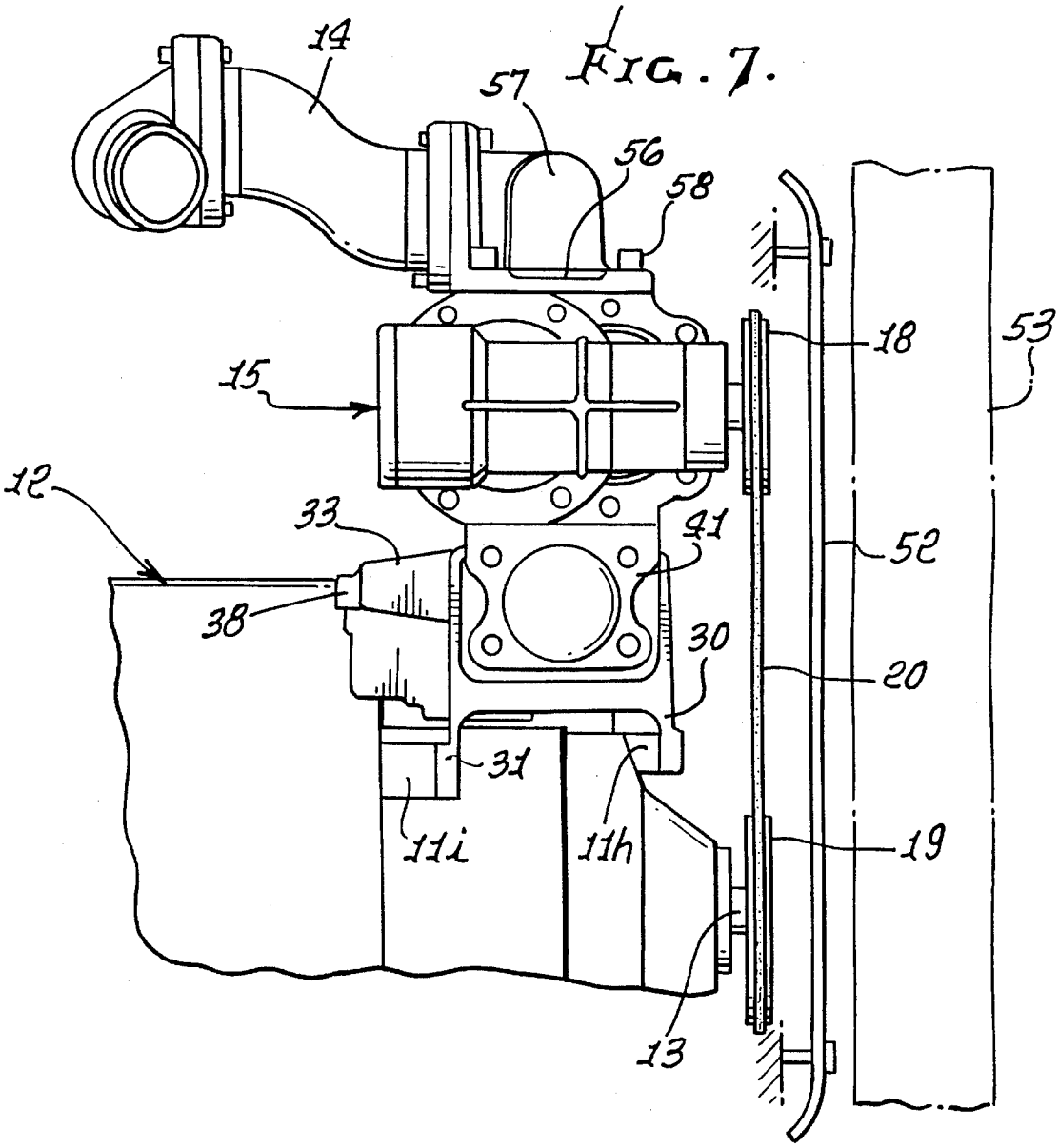
FIGS. 7 and 8 are front and rear views of the mounted supercharger and its platform.
Figure 8:
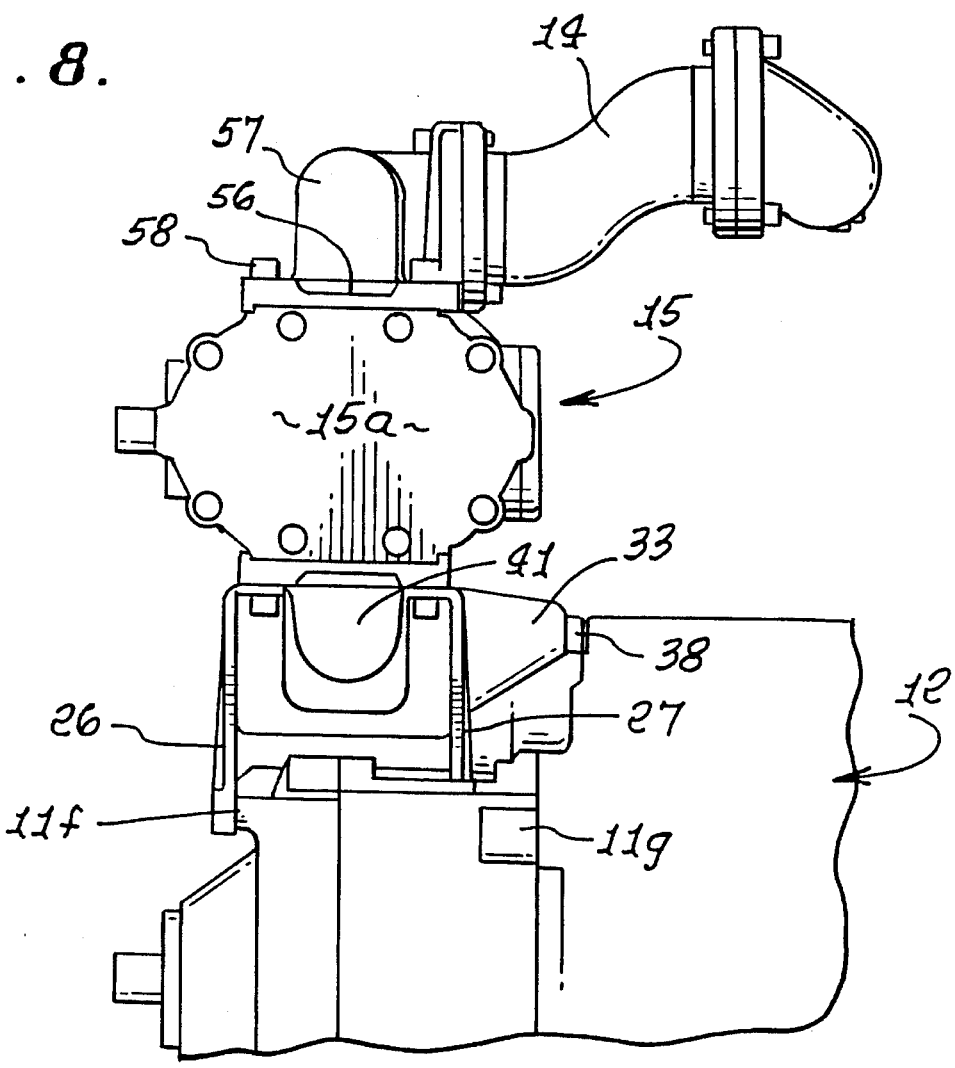
Figure 12:
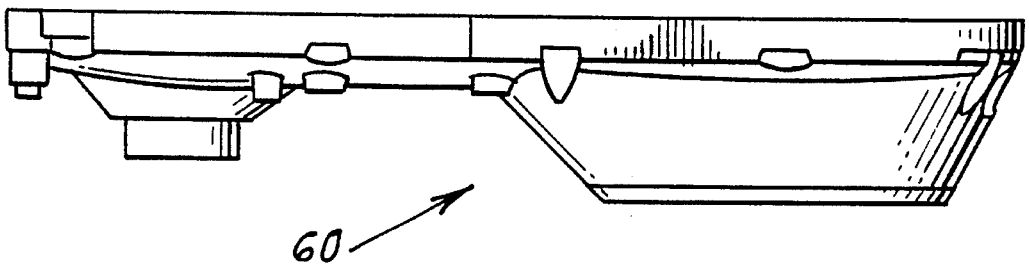
FIG. 12 is a top plan view of the FIG. 9 plate.

The supercharger (blower) housing 15*a* is carried by or mounted on a support sidewardly of the engine. See for example the metal platform 23 extending horizontally with the housing 15*a* bolted to the platform top 23*a* at the locations 24. The support has mounting arm means operatively connected to the motorcycle engine or frame, whereby the housing 15*a* may be rigidly carried to extend longitudinally and closely sidewardly to the engine cylinders. The arm means referred to may include left and right pairs of arms 26 and 27, 28, and 29, and 30 and 31, the upper ends of which are integral with the platform. The arms of each pair are rigidly interconnected, as by cross bars 32 seen in FIGS. 4 and 6, whereby a very strong, reinforced, box-like support is provided for the supercharger. Arm lower ends are bolted to frame or engine structure, as for example is seen at 11*f* and 11*g* in FIGS. 6 and 8, and at 11*h* and 11*i* in FIG. 7. Note also the side arm 33 integral with the platform proximate the apexes formed by arms 29 and 31, and projecting laterally for connection to the engine at 38, as seen in FIGS. 7 and 8. This rigidizes the support, laterally, while allowing for very compact construction.

The platform is typically centrally vertically open at 40, and forwardly open at 40*a*, to provide access of a blower air/fuel inlet manifold 41, for connection to the underside of the blower housing, at the housing air inlet, in a very compact relation. That manifold extends forwardly beneath the level of the rotor 18 and is operatively connected to means supplying fuel and air to the manifold. See in FIG. 2 the air intake filter 46 and carburetor 47 (or a fuel injector), interconnected at 48, and connected at 49 to the forward end of the manifold. Accordingly, the platform carries all of the supercharger structure, including the bolt-on housing 15*a*, inlet manifolding 41, and the drive parts 73 and 18 in a highly compact manner, easily assembled by the user. If desired, the tensioning pulley 21 for belt 20 entrained around pulleys 18 and 19 can be carried by the arm means integral with the platform, as indicated at 50 in FIG. 2. A side cover plate can be provided, as seen at 52 in FIG. 7, to cover the drive elements, the leg of the rider also indicated at 53 in FIG. 7.

Duct means is also provided to extend between the supercharger housing upper outlet 56 and the engine air/fuel intake manifold 14. See the ducting at 57 in FIG. 7, and bolted at 58 to the top of the manifold housing. Manifold 14 extends from ducting 57, laterally, to a V-shaped region between the forward and rearward engine cylinder blocks (finned).

FIGS. 2 and 9–12 show a second upright and protection cover plate 60 bolted to the frame, and sidewardly covering the lower (drive) pulley or rotor 19, and cycle structure rearward thereof. See bolts 60*a* and engine crankcase 10*b*.

In FIGS. 9–13, elements are as follows:

Element 100 is an engine crankcase. Element 101 is an inner primary cover attached to the crankcase. Element 102 is a sprocket crank shaft driven by the engine. Element 103 is a compensating sprocket which drives the clutch chain of the motorcycle, and is driven via key 103*a*. Element 104 is a sliding cam and compensating sprocket cover. Element 105 is a compensating crank sprocket nut that is connected to shaft 102 and has a female drive slot 105*a* in flange 105*b*. element 106 is the output pulley drive shaft. Element 107 is a male slot connector or lug on the end of shaft 106, that fits slot 105*a*, to be driven. Element 108 is an output pulley drive shaft support and mounting housing, covered by cover 60. Element 109 is the output pulley, to drive the supercharger, and corresponds to 19. Element 110 is a drive pulley retainer washer. Element 111 is a drive pulley retainer bolt, received in the end of shaft 106. Element 112 is a belt guard mounting and stabilizing bracket that is star or circular-shaped.

Figure 9:
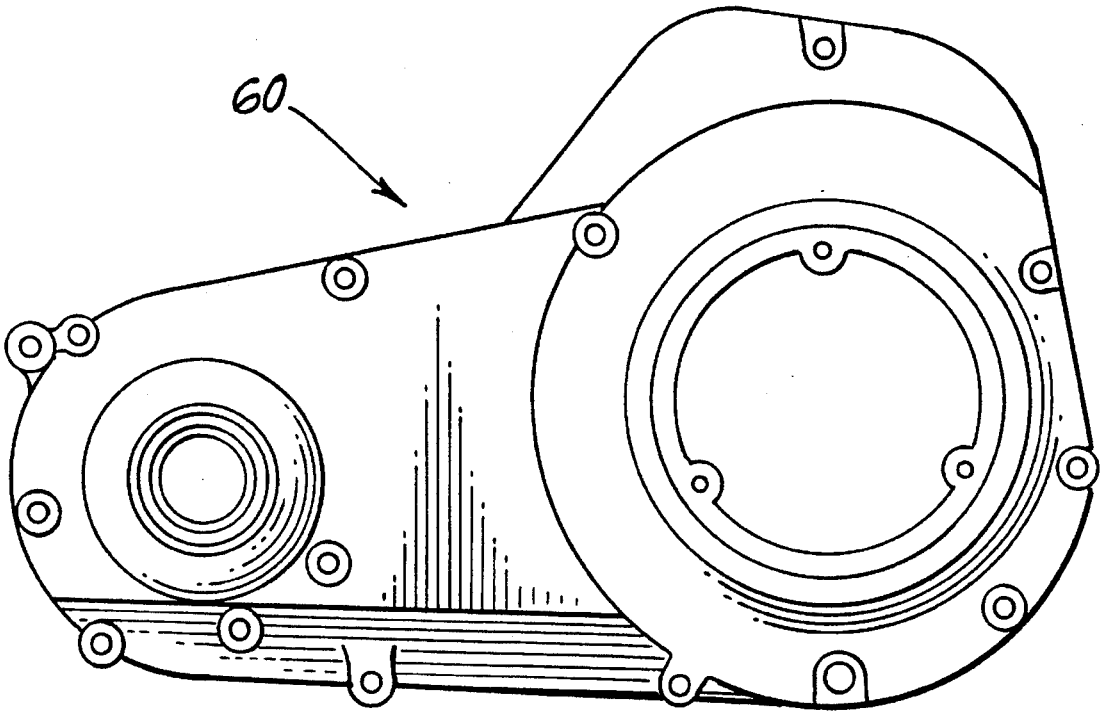
FIG. 9 is a side elevation showing a cover plate.
Figure 10:
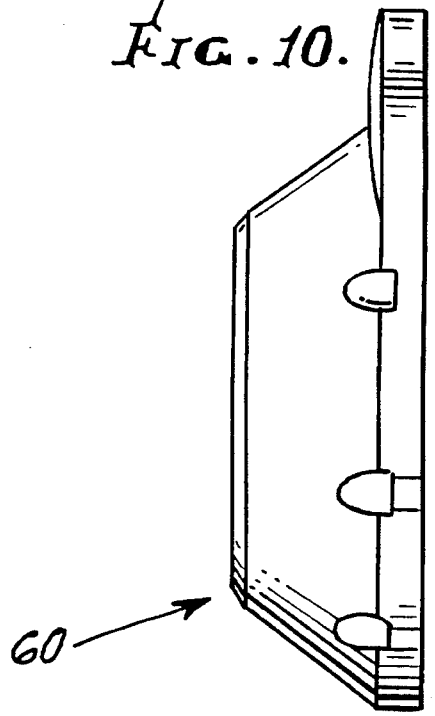
FIG. 10 is a right end view of the FIG. 9 plate.
Figure 11:
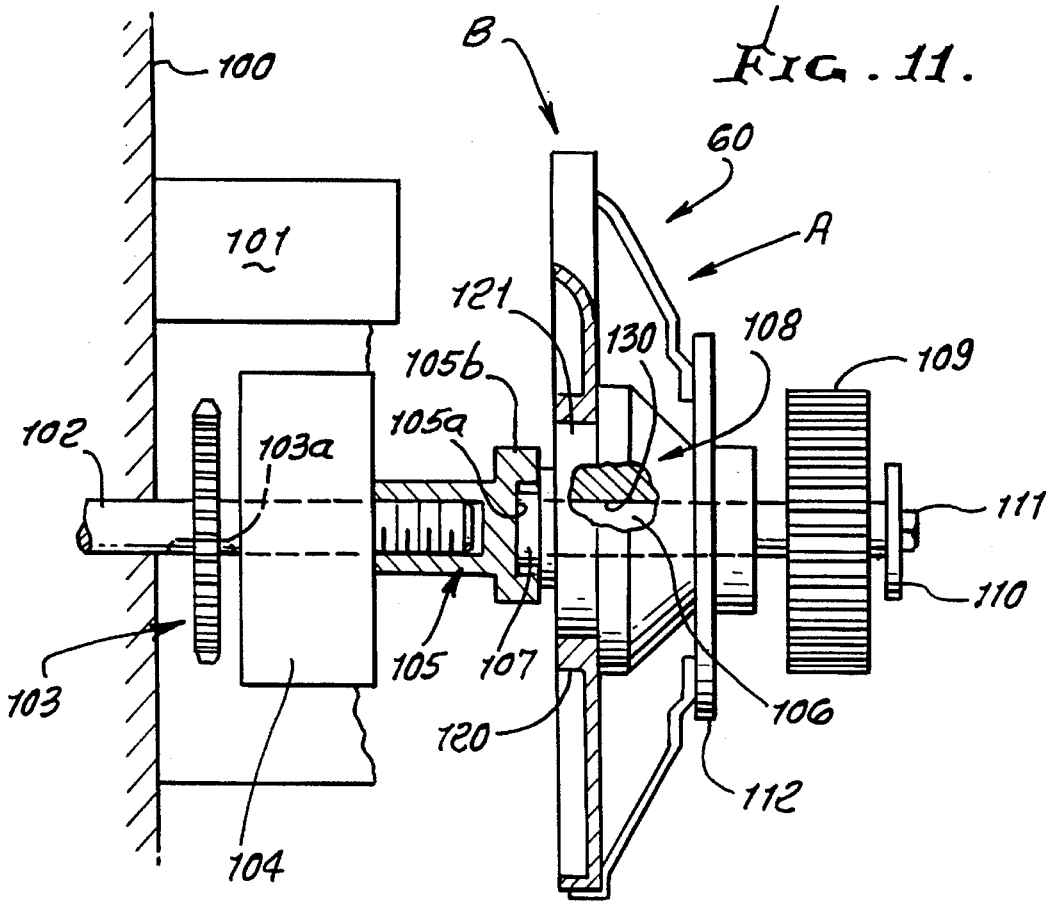
FIG. 11 is a left end view of the FIG. 9 plate, and also showing structure incorporating the invention.

It will be noted that cover 60 has an integral annular ring 120 receiving annular support 121 on element 108, and elements 120 and 121 may be welded together, so that element 108 and cover 60 are a one-piece assembly, usable on a wide range of motorcycles. Support 121 is in the form of a flange. Shaft is easily removed endwise from element 108, since it is received in bore 130 of element 108, the latter and cover 60 bolted to the motorcycle frame. Elements A and B of 60 are as indicated in FIGS. 9 and 11.

Figure 13:
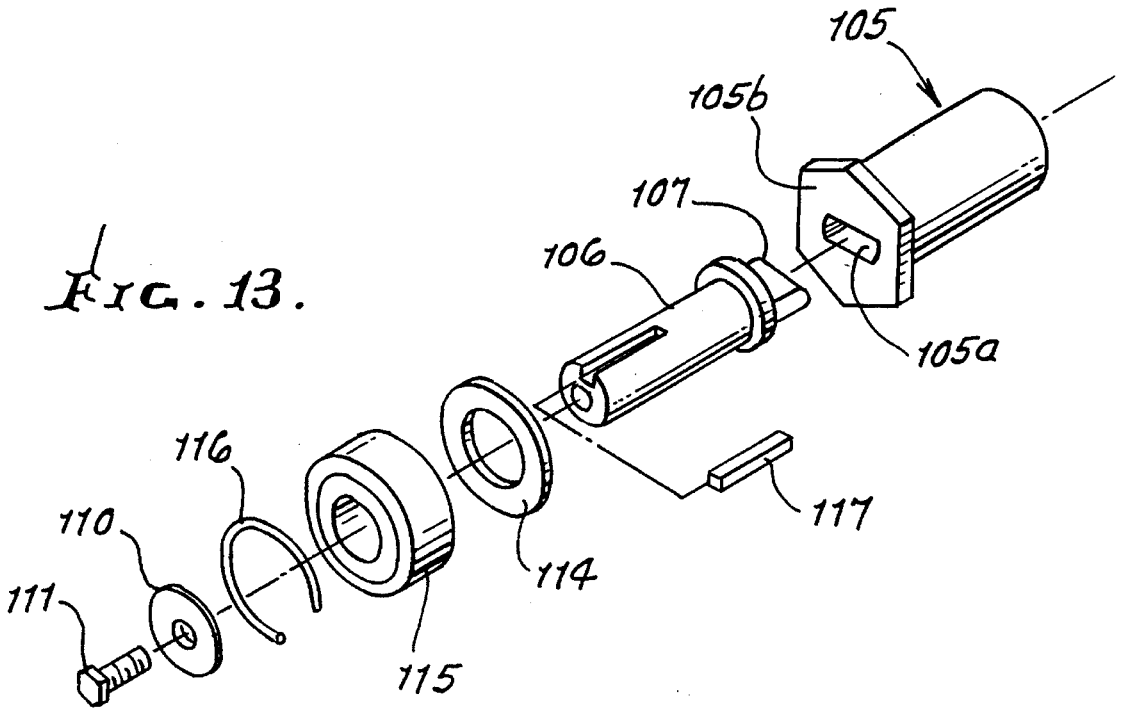
FIG. 13 is a perspective view of drive shaft assembly structure.

Also shown in FIG. 13 are a drive shaft seal annulus 114, a drive shaft bearing 115, and a bearing retainer 116. Elements 114 and 116 are within 109 in FIG. 11. A key 117 seen in FIG. 13 attaches element 106 to element 109.

I claim:

1. In combination with a cover plate attached to a motorcycle to cover transmission structure, and an annular bore on the cover plate defining an axis, said motorcycle including an engine drive shaft having an axis, said cover plate axis being coincident with the motorcycle engine drive shaft axis, the combination comprising:

a) a sprocket shaft axially spaced from said drive shaft, b) a compensating nut on the sprocket shaft, c) an output pulley drive shaft coaxially aligned and coupled to said sprocket shaft and said compensating nut, and an output pulley on said output pulley drive shaft for transmitting drive to a supercharger for said engine, and d) mounting means extending about the output pulley drive shaft, and received adjacent said annular bore on the cover plate to center the output pulley drive shaft in spaced relation to the engine drive shaft.

2. The combination of claim 1 wherein said compensating nut and said output pulley drive shaft have telescopically interfitting parts for transmitting rotation from the output pulley drive shaft to said sprocket shaft via said nut.

3. The combination of claim 2 wherein said parts comprise a recess in said nut facing said output pulley drive shaft, and a lug on the output pulley drive shaft to be fittingly received, axially, in said recess.

4. The combination of claim 1 wherein said sprocket shaft has an end portion that is externally threaded, and said nut is received on and over said end portion and has threaded engagement with said end portion.

5. The combination of claim 3 wherein said sprocket shaft has an end portion that is externally threaded, and said nut is received on and over said end portion, and has threaded engagement with said end portion.

6. The combination of claim 4 wherein said nut includes a flange, there being a recess in said flange in axial alignment with said sprocket shaft, and there being a lug on said output pulley drive shaft, the lug axially received in said recess.

7. The combination of claim 1 wherein said mounting means includes a flange received in said annular bore.

8. The combination of claim 1 including said cover plate attached to said mounting means, and relative to which the output pulley drive shaft is rotatable.

* * * * *